US006917149B2

(12) United States Patent
Jeon et al.

(10) Patent No.: US 6,917,149 B2
(45) Date of Patent: Jul. 12, 2005

(54) TENSION MASK HAVING SHAPED APERTURES FOR COLOR CATHODE-RAY TUBE AND TENSION MASK FRAME ASSEMBLY

(75) Inventors: Sang-Ho Jeon, Seongnam (KR); Jong-Han Rhee, Suwon (KR); Kun-Moo Lee, Seoul (KR)

(73) Assignee: Samsung SDI, Co., Ltd., Suwon-si (KR)

( * ) Notice: Subject to any disclaimer, the term of this patent is extended or adjusted under 35 U.S.C. 154(b) by 328 days.

(21) Appl. No.: 10/232,676

(22) Filed: Sep. 3, 2002

(65) Prior Publication Data

US 2003/0048061 A1 Mar. 13, 2003

(30) Foreign Application Priority Data

Sep. 11, 2001 (KR) ..... 2001-55914

(51) Int. Cl.[7] ..... H01J 29/80

(52) U.S. Cl. ..... 313/402; 313/403

(58) Field of Search ..... 313/402, 403

(56) References Cited

U.S. PATENT DOCUMENTS

| | | | | |
|---|---|---|---|---|
| 3,638,063 | A | 1/1972 | Tachikawa et al. | |
| 4,942,332 | A | 7/1990 | Adler et al. | |
| 4,973,283 | A | 11/1990 | Adler et al. | |
| 6,313,574 | B1 * | 11/2001 | Banno et al. | 313/402 |

* cited by examiner

*Primary Examiner*—Vip Patel
(74) *Attorney, Agent, or Firm*—Robert E. Bushnell, Esq.

(57) ABSTRACT

A tension mask for a color cathode-ray tube includes a plurality of strips separated by a predetermined distance and connected by real bridges. The strips define slots, through which an electron beam passes, together with the real bridges. The slots are formed such that the width of middle portions of the slots is narrower than the width of upper and lower portions of the slots in order to compensate for contraction of the strips arising when tension is applied to the strips.

26 Claims, 9 Drawing Sheets

TENSION MASK HAVING SHAPED APERTURES FOR COLOR CATHODE-RAY TUBE AND TENSION MASK FRAME ASSEMBLY

CLAIM OF PRIORITY

This application makes reference to, incorporates the same herein, and claims all benefits accruing under 35 U.S.C. §119 from an application entitled TENSION MASK FOR CRT AND TENSION MASK FRAME ASSEMBLY filed with the Korean Industrial Property Office on 11 Sep. 2001 and there duly assigned Ser. No. 55914/2001.

BACKGROUND OF THE INVENTION

1. Field of the Invention

The present invention relates to a flat color cathode-ray tube (CRT), and more particularly, to a tension mask for a CRT having a color selection function and a tension mask frame assembly.

2. Description of the Related Art

In typical color CRTs used for computer monitors and televisions, three electron beams emitted from an electron gun pass through beam passage holes of a mask for color selection and land on red, green and blue phosphors of a phosphor layer formed on the screen of a panel to excite the phosphors, thereby forming an image. In such conventional color CRTs, representative masks for color selection are dot masks employed in computer monitors and slot (or slit) masks employed in televisions. Such dot and slot masks are designed to have a curvature corresponding to the curvature of a screen because the screen is formed to have a predetermined curvature taking into account landing of deflected electron beams.

The above-described masks are formed by etching a thin plate having a thickness of 0.1–0.25 mm (millimeters) to form a plurality of beam passage holes and shaping the thin plate to have a predetermined curvature. If the conventional masks do not have at least a predetermined curvature, their structural strength is weak, so the masks can be plastically deformed during fabrication of CRTs. Consequently, the masks cannot perform their inherent color selection function. Recently, CRTs tend to be flat, and the conventional flat CRTs impose many restrictions on the fabrication of completely flat CRTs.

U.S. Pat. No. 3,638,063 by Tachikawa et al. for Grid Structures for Color Picture Tubes discloses an aperture grill-type mask for preventing a doming effect and achieving flatness. In this aperture grill-type mask, strips made of a thin steel plate having a thickness of 0.1 mm (millimeter) are not coupled, and only both ends of each of the strips are supported by a frame, so the strips are individually caused to vibrate even by slight impact to thus cause howling of a screen.

U.S. Pat. No. 4,942,332 by Adler et al. for Tied Slit Mask for Color Cathode Ray Tubes discloses a slot-type mask. A slot-type mask includes a plurality of strips separated from each other by a predetermined distance to thus form slots and tie bars coupling the strips. A long side of the mask is fixed to a support member.

In this mask, the tie bars coupling the strips serve to reduce howling of a screen arising from the vibration of the mask due to external impact but do not make a great contribution to reproduction of Poisson contraction occurring when tension is applied to the mask. In other words, when tension within an elastic limit is applied to the mask in a vertical direction, the mask expands in the vertical direction and contracts in a horizontal direction. Accordingly, slots at both end portions of the mask are displaced, and the edges of the short sides of the mask move outward due to the tie bars when the mask thermally expands.

In addition, when tension is applied to the strips, the slots defined by the strips and the tie bars have a wider horizontal width at their middle than a horizontal width at their upper and lower portions due to Poisson contraction of the strips.

Such nonuniformity of a strip width causes collimation of strips to be poor and furthermore causes collimation of red, green, and blue strip patterns to be poor during exposure of a phosphor layer, so the phosphor layer cannot be formed in a uniform pattern.

Such change in slots occurring when tension is applied to strips is greater in a long slot-type mask. Such a long slot-type mask is disclosed in U.S. Pat. No. 4,973,283 issued to Adler et al. for Method of Manufacturing a Tied Slit Mask CRT. U.S. Pat. No. 4,973,283 restricts a mask such that the result of dividing the vertical pitch of a slot by the horizontal pitch of the slot should be greater than 16 (vertical pitch/horizontal pitch>16) in order to minimize the quantity of movement of a slot at the edge of an effective surface. When the slots get longer as described above, the strips defining the slots also get longer. As a result, excessive Poisson contraction of the strips is induced, and the width of each slot at its middle portion is wider than the width of the slot at its upper and lower portions.

SUMMARY OF THE INVENTION

To solve the above-described and other problems, it is an object of the present invention to provide a tension mask for a color cathode-ray tube (CRT), which compensates for Poisson contraction with tension applied to strips in a lengthwise direction (in a Y-axis direction), thereby preventing the horizontal width of slots from changing and preventing the collimation of strips from decreasing due to the change in width.

It is another object to provide a tension mask for a display device that is easy and inexpensive to manufacture.

It is yet another object to provide a tension mask for a display device that compensates for distortion of slots of the tension mask.

To achieve the above and other objects of the present invention, in one aspect, there is provided a tension mask for a color cathode-ray tube. The tension mask includes a plurality of strips separated by a predetermined distance and connected by real bridges, the strips defining slots, through which an electron beam passes, together with the real bridges; and a shape compensation unit for compensating for distortion of the shape of the slots due to contraction of the strips arising when tension is applied to the strips.

In another aspect, there is provided a tension mask for a color cathode-ray tube including a plurality of strips separated by a predetermined distance and connected by real bridges. The strips together with the real bridges define slots through which an electron beam passes. The slots are formed such that the width of middle portions of the slots is narrower than the width of upper and lower portions of the slots in order to compensate for contraction of the strips arising when tension is applied to the strips.

Both longer sides of each of the slots defined by the strips and the real bridges have convex curves. If it is assumed that the width of middle portions of the slots is SW3 (mm) and the width of upper and lower portions of the slots is SW4, the slots are formed to satisfy 1.0<SW4/SW3<1.3.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
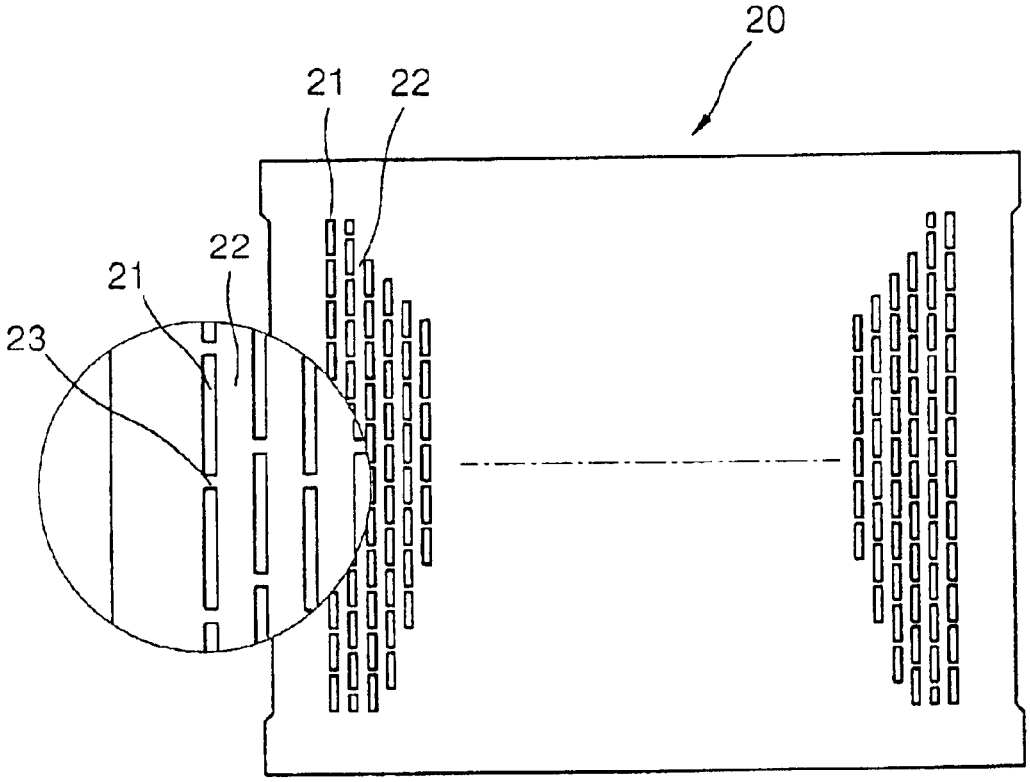
FIG. 1 (PRIOR ART)
FIG. 1 is a plan view of a conventional mask for a flat cathode-ray tube (CRT)

Turning now to the drawings, as shown in FIG. 1, a slot-type mask 20 includes a plurality of strips 22 separated from each other by a predetermined distance to thus form slots 21 and tie bars 23 coupling the strips 22. A long side of the mask 20 is fixed to a support member (not shown).

In this mask 20, the tie bars 23 coupling the strips 22 serve to reduce howling of a screen arising from the vibration of the mask due to external impact but do not make a great contribution to reproduction of Poisson contraction occurring when tension is applied to the mask 20. In other words, when tension within an elastic limit is applied to the mask 20 in a vertical direction, the mask expands in the vertical direction and contracts in a horizontal direction. Accordingly, slots at both end portions of the mask 20 are displaced, and the edges of the short sides of the mask 20 move outward due to the tie bars 23 when the mask 20 thermally expands.

Figure 2:
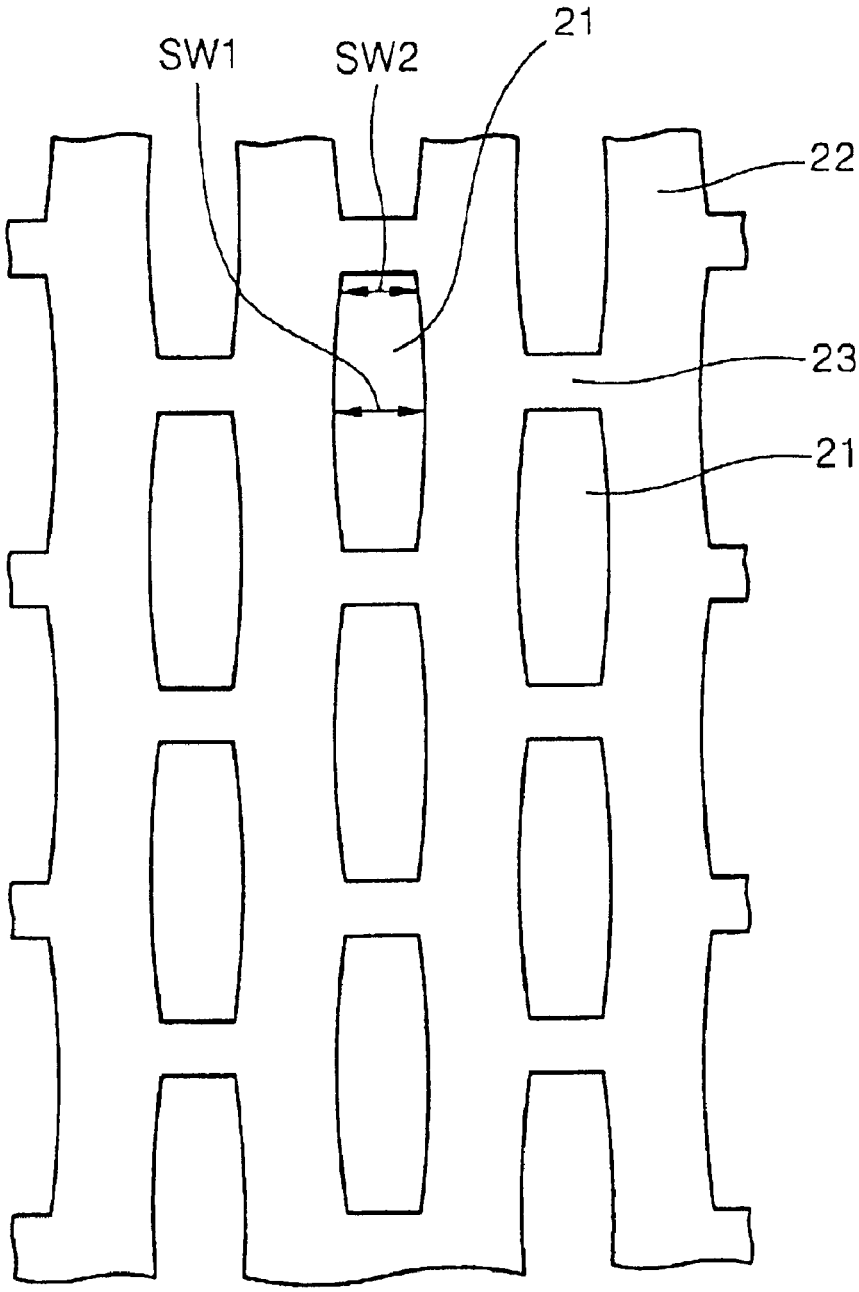
FIG. 2 (PRIOR ART)
FIG. 2 is an enlarged plan view of a partially cut away portion of the mask shown in FIG. 1.

In addition, when tension is applied to the strips 22, as shown in FIG. 2, the slots 21 defined by the strips 22 and the tie bars 23 have a wider horizontal width SWb1 at their middle than a horizontal width SWb2 at their upper and lower portions due to Poisson contraction of the strips 22.

Figure 3:
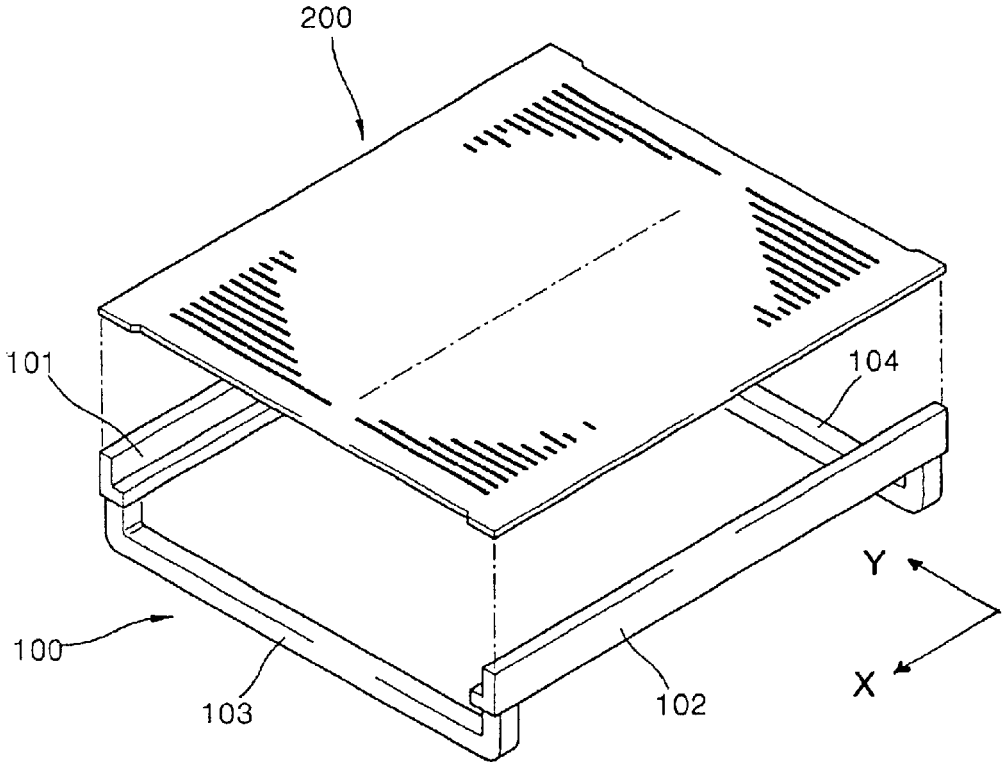
FIG. 3 is an exploded perspective view of a tension mask frame assembly according to the present invention.

FIG. 3 shows a tension mask according to the present invention and a tension mask frame assembly in which a frame for supporting a tension mask is combined with the tension mask. As shown in FIG. 3, the tension mask frame assembly includes a frame 100 and a tension mask 200. The frame 100 includes a pair of support members 101 and 102 which are disposed in parallel to each other and are separated by a predetermined distance, and elastic members 103 and 104 that have both ends fixed to the support members 101 and 102, respectively, thereby supporting the support members 101 and 102. The tension mask 200 is supported by the support members 101 and 102 of the frame 100 at its opposite sides in a lengthwise direction so that tension is applied to strips which will be described later. The tension mask 200 is provided with a shape compensation unit for compensating for distortion of the shape of slots due to contraction of the strips induced when the tension is applied.

The support members 101 and 102 of the frame 100 can be formed straight or bent to have a predetermined curvature based on the curvature of a screen of a cathode-ray tube (CRT). A frame according to the present invention is not restricted to the above described one, and any frame which can support the tension mask 200 so that tension can be applied to the tension mask 200 can be used.

Figure 4:
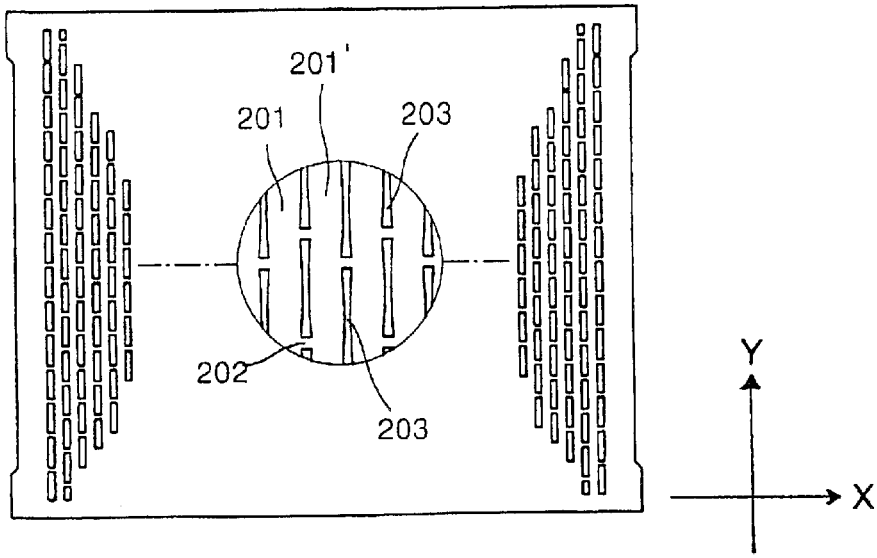
FIG. 4 is a plan view of an embodiment of a tension mask according to the present invention.
Figure 5:
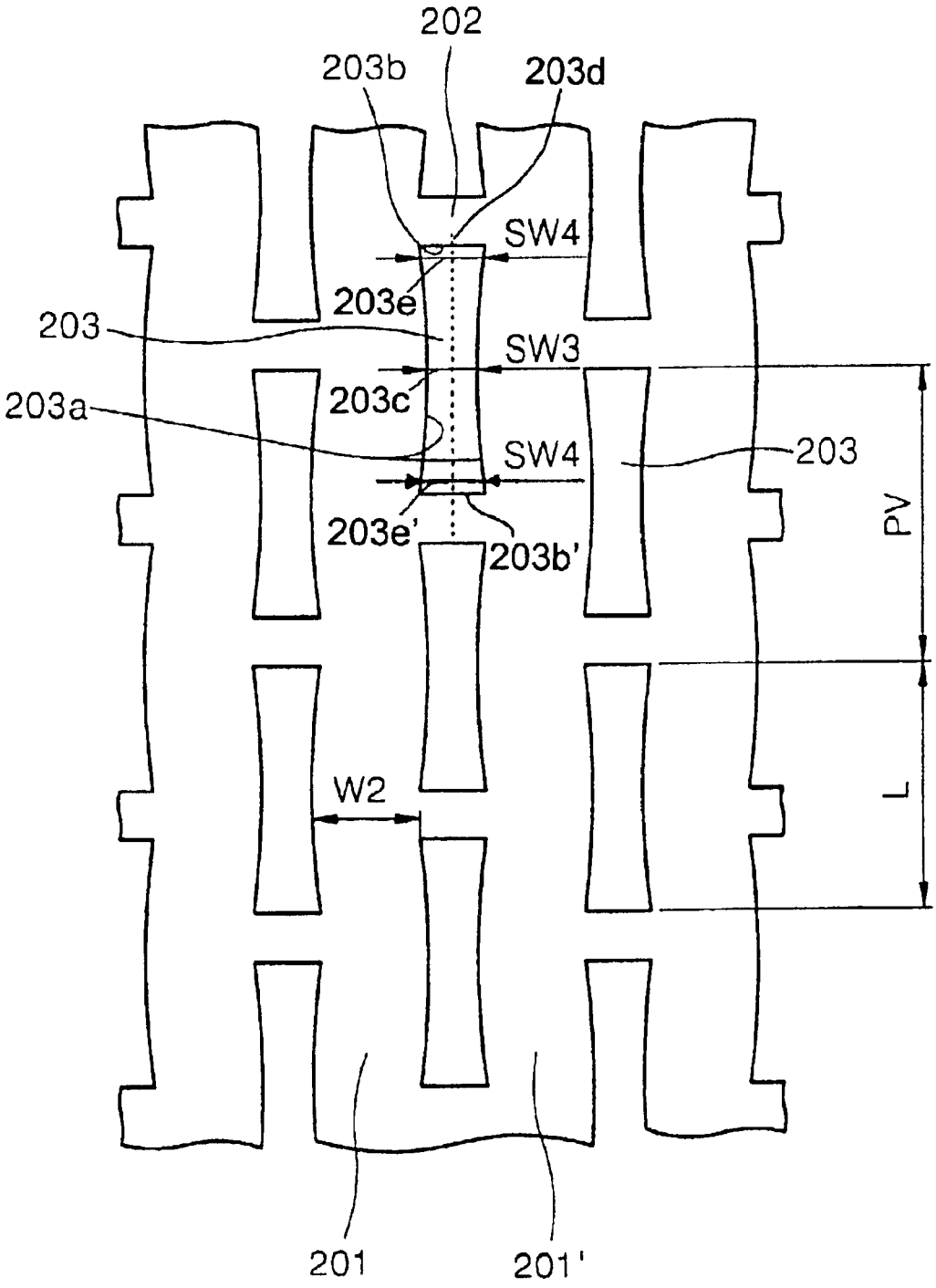
FIG. 5 is an enlarged plan view of a portion of the tension mask shown in FIG. 4.

The tension mask 200 is made of a thin plate. As shown in FIGS. 3 and 4, a plurality of strips 201 and 201' are formed at predetermined intervals, and a plurality of slots 203 are defined by real bridges 202 connecting the strips 201 and 201'. The real bridges 203 are arranged randomly. As shown in FIGS. 4 and 5, in each of the slots 203 defined by the strips 201 and 201' and the real bridges 202, the width SW3 in the middle portion is narrower than the width SW4 in the upper and lower portions in a state where tension is not applied to a tension mask. In other words, both longer sides of each of the slots 203 have curves 203*a* which are convex so that the width SW3 of the slot 203 at its middle portion is narrower than the width SW4 of the slot 203 at its upper and lower portions. The curve 203 is formed to have a continuous curvature from a corner (or end portion) 203*b* to a center. The width of the slot 203 continuously or gradually decreases from opposing end portions 203*b* and 203*b'* to the middle portion 203*c*. Both curved longer sides 203*a* of each slot 203 are convex curves that curve toward a medial dotted line 203*d* parallel with the longer sides 203*a* of the slot 203. Accordingly, in a state where tension is not applied to the strips 201 and 201', the width of the strips 201 and 201' on the opposite sides of the middle portion of each of the slots 203 is wider than the width of the strips 201 and 201' on the opposite sides of the upper and lower portions of each of the slots 203. The upper portion 203*e* of the slots 203 can be further defined as the area above the middle portion 203*c* and up to and including the upper end portion 203*b*. The lower portion 203*e'* of the slots 203 can be further defined as the area below the middle portion 203*c* and up to and including the lower end portion 203*b'*. Furthermore, the shape compensation unit or the shape compensating means can be the forming of the width of the middle portion of the slots 203 being narrower than the width of upper and lower portions of the slots 203.

It is preferable that the width SW3 (mm) at the central portion and the width SW4 (mm) at the upper and lower portions are set to satisfy 1.0<SW4/SW3<1.3. The restriction by the above formula varies with a portion of the tension mask 200 due to a difference in tension applied in a Y-axis direction to the strips 201 and 201', which are arranged in an X-axis direction in which the tension mask has a longer side, and with the size of the tension mask 200. Since a value of SW4/SW3 can change according to a portion of the tension mask 200, it will be apparent that a value of SW4/SW3 should be adjusted according to a portion of the tension mask 200 taking into account Poisson contraction based on tension applied to the strips 201 and 201'.

Figure 6:
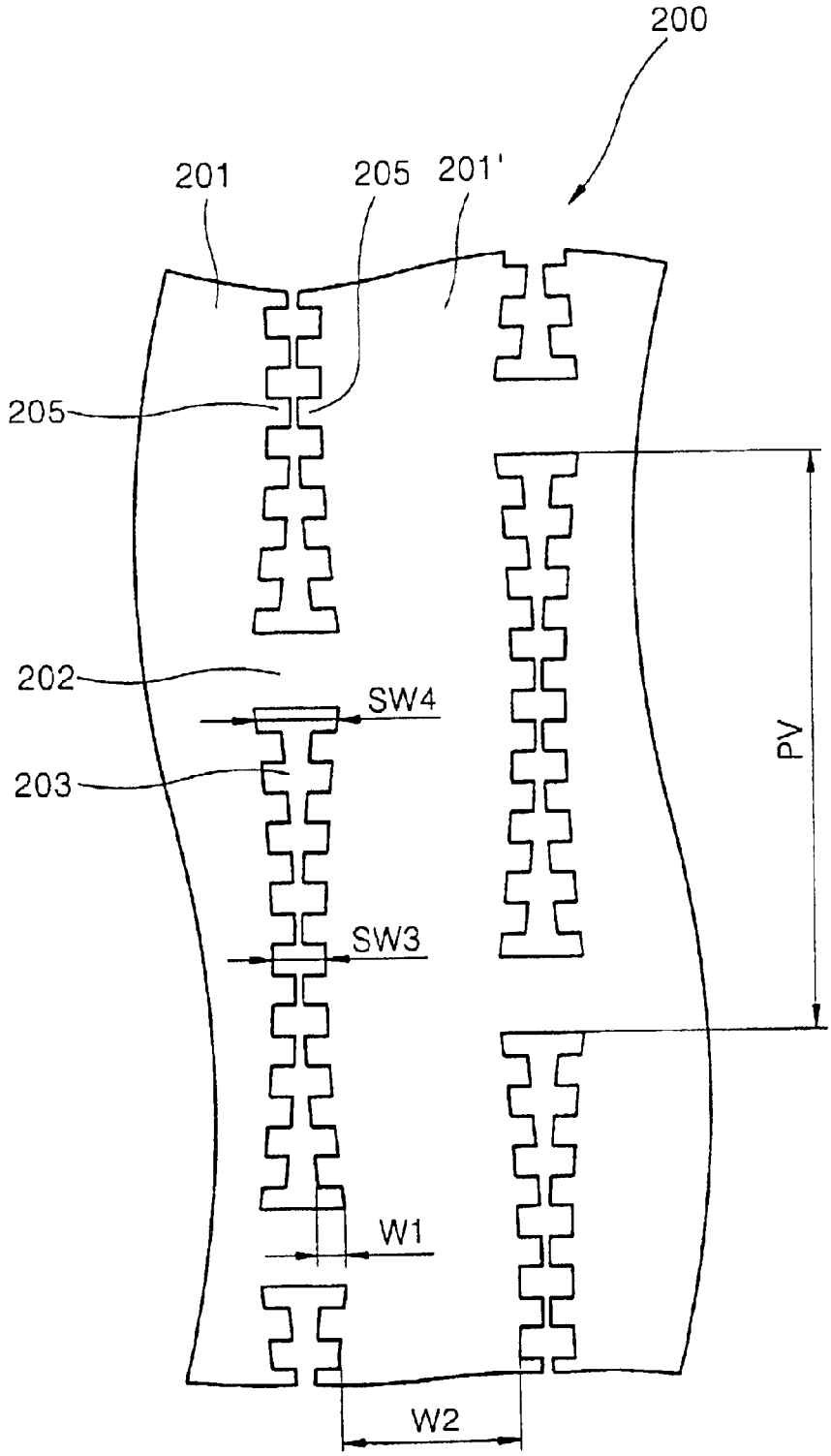
FIGS. 6 and 7 are partially cut away plan views of other embodiments of a tension mask according to the present invention.
Figure 7:
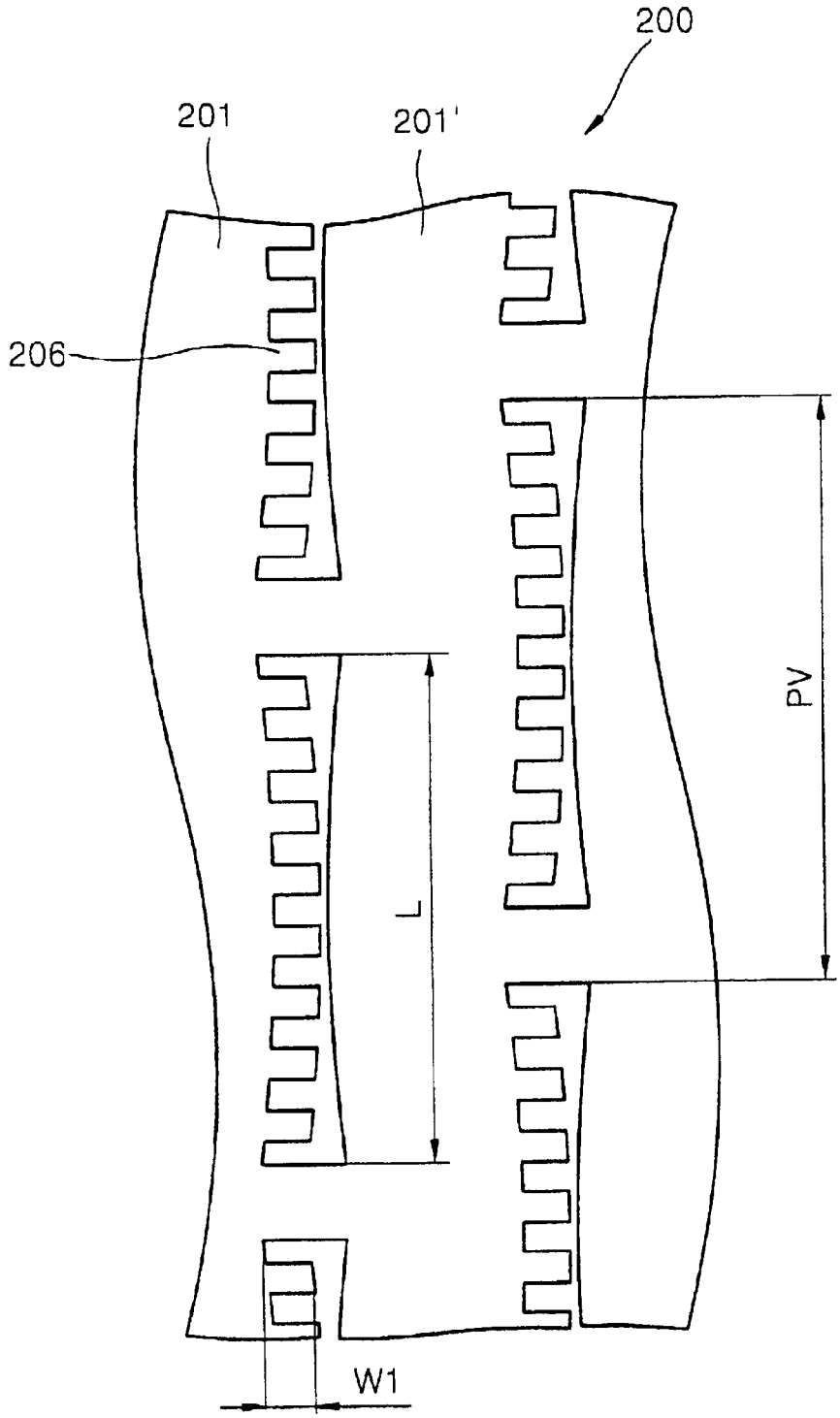

FIGS. 6 and 7 show other embodiments of a tension mask according to the present invention. Referring to FIGS. 6 and 7, in a state where tension is not applied to a tension mask 200, the width SW3 of a slot 203, which is defined by strips 201 and 201' and real bridges 202, at its center is narrower than the width SW4 of the slot 203 at its upper and lower portions. Dummy bridges 205 and 206 extend from at least one side of each of the strips 201 and 201'. As shown in FIG. 6, the dummy bridges 205 may extend from opposite sides of each of the strips 201 and 201' facing in opposite directions. Alternatively, as shown in FIG. 7, tension mask 200 includes the dummy bridges 206 that may extend from one side of each of the strips 201 and 201' toward the other side. When the dummy bridges 205 extend from opposite sides facing in opposite directions, as shown in FIG. 6, they do not contact. Here, it is preferable that the dummy bridges 205 and 206 have a uniform width W1 taking into account deformation of the slots 203. A tension mask according to the present invention is not restricted to the above embodiments, but any tension mask having a structure through which Poisson contraction due to application of tension can be compensated for can be used.

Hereinafter, the actions of a tension mask and a tension mask frame assembly according to the present invention will be described.

Figure 8A:
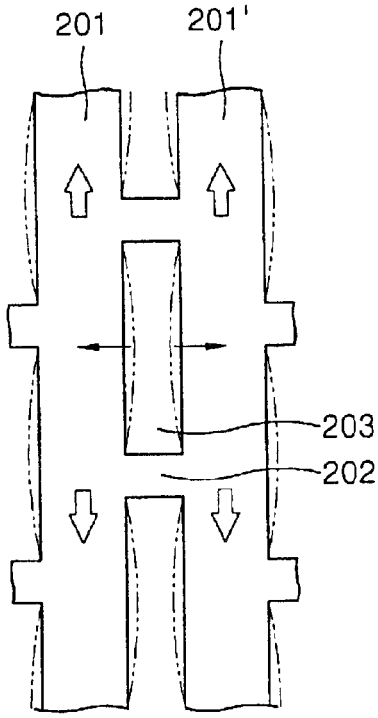
FIGS. 8A and 8B are partially cut away plan views of tension masks according to the present invention and show deformation of slots when tension is applied to the tension masks.
Figure 8B:
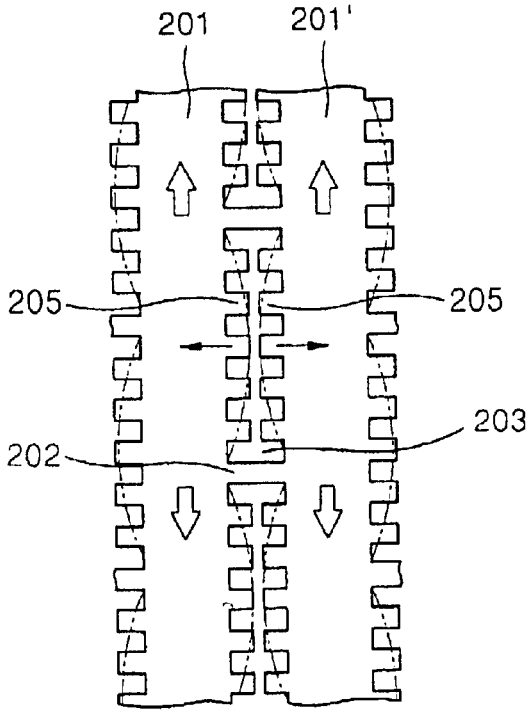

The following description concerns the action of tension applied to the tension mask 200 fixed on the support members 101 and 102. When the tension mask 200 is welded to the support members 101 and 102, tension is applied to the tension mask 200 in a Y-axis direction, inducing Poisson contraction. Here, since the width SW3 of the slots 203 at their middle portions is narrower than the width SW4 thereof at their upper or lower portions on the tension mask 200, the width W2 of the strips 201 and 201' becomes narrower due to Poisson contraction when tension is applied to the tension mask 200 in the Y-axis direction. As a result, the width SW3 of the slots 203 at their middle portions becomes wider. Accordingly, after tension is applied to the tension mask 200, the shape of the slots 203 becomes rectangular, as shown in FIGS. 8A and 8B.

The tension applied to the tension mask 200 in the Y-axis direction changes in an X-axis direction according to the structure of the frame 100 supporting the tension mask 200. The distribution of tension in the X-axis direction of the tension mask 200 has a U- or A-shaped distribution in which the tension near the edge of the tension mask 200 is greater or smaller than the tension at the center of the tension mask 200. When the tension applied to the strips 201 and 201' has a U-shaped distribution, displacements of strips 201 and 201' near the edge of the tension mask 200 are greater than the displacements of strips 201 and 201 ' at the center thereof, so the width SW3 of the slots 203 at their middle portions decreases from the center toward the edge on the tension mask 200. When the tension applied to the strips 201 and 201' has an A-shaped distribution, the displacements of strips 201 and 201' at the center of the tension mask 200 are greater than the displacements of strips 201 and 201' near the edges thereof, so the width SW3 of the slots 203 at their middle portions increases from the center toward the edge on the tension mask 200.

In addition, in the tension mask 200, Poisson contraction may change according to the vertical pitch of the slots 203 (or the vertical pitch of the real bridges 202). According to experiments performed taking into account the above facts, when the result of dividing the width SW4 of the slots 203 at their upper or lower portions by the width SW3 of the slots 203 at their middle portions was greater than 1 and smaller than 1.3, distortion of the slots 203 defined by the strips 201 and 201' and the real bridges 202 could be compensated for in the case where tension was applied to the tension mask 200, and the collimation of the strips 201 and 201' could be improved.

These effects will be proved through the following experiments.

Experiment 1

Figure 9:
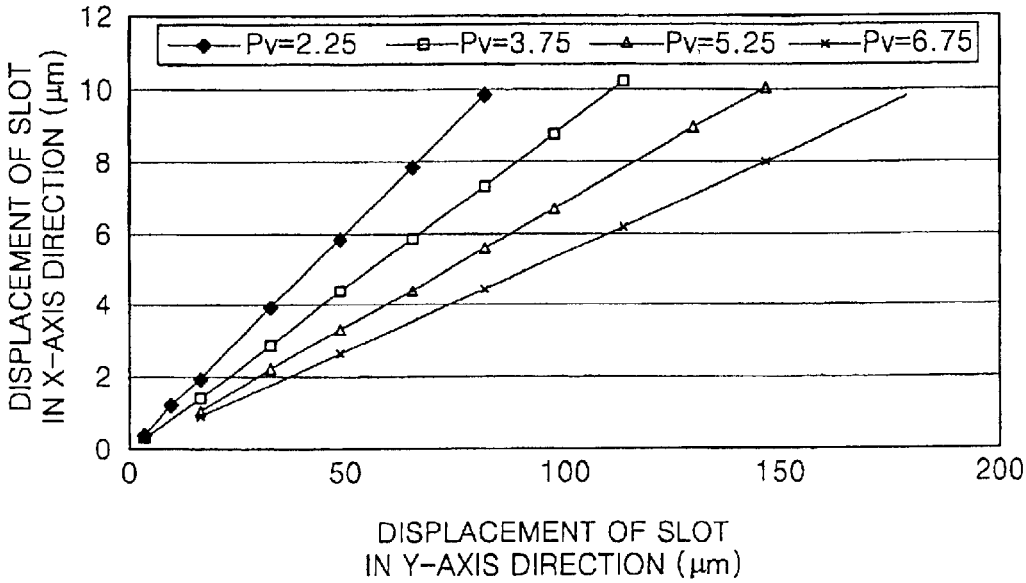
FIG. 9 is a graph of the displacement of slots along an X-axis versus the displacement of slots along a Y-axis when tension is applied to a mask according to the present invention.

The quantities of displacement of slots in X-axis and Y-axis directions were measured at vertical slot pitches PV of 2.25 mm (millimeters), 3.75 mm, 5.25 mm, and 6.75 mm when a predetermined tension was applied to a tension mask in a longitudinal direction. The results are shown in FIG. 9. Here, a plurality of dummy bridges were formed at each of the slots having the above vertical pitches PV such that the dummy bridges extended from strips defining the corresponding slot (see FIGS. 6, 7, and 8B).

As seen from the graph of FIG. 9, the width of the slots 203 in the X-axis direction (at the middle portions of the slots 203) decreases as the vertical slot pitch increases. When the vertical slot pitch is very small, the width of the slots 203 in the X-axis direction increases more rapidly.

Experiment 2

Figure 10:
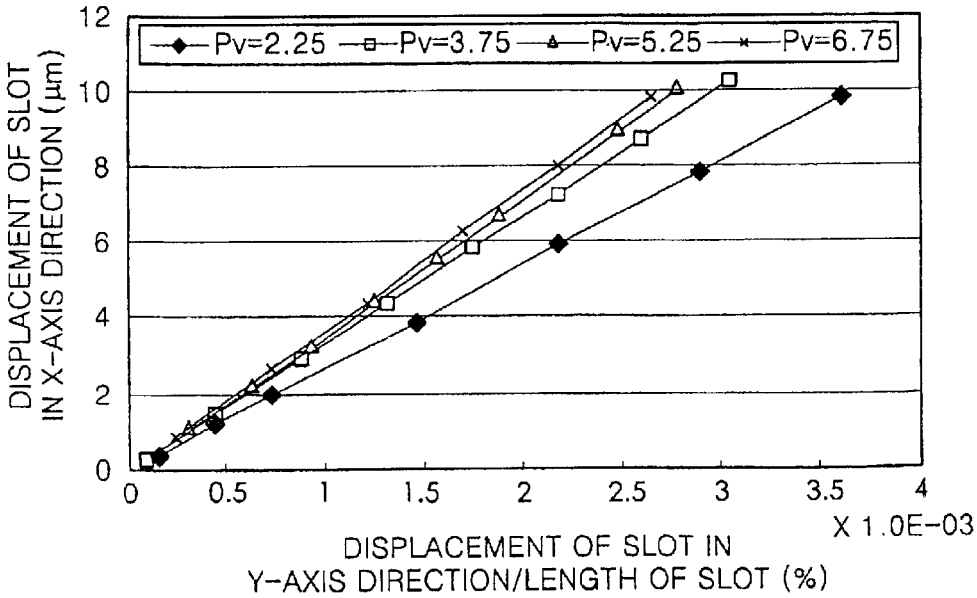
FIG. 10 is a graph of the displacement of slots along an X-axis versus the displacement of slots along a Y-axis divided by the length of the slots when tension is applied to a mask according to the present invention.
Figure 11:
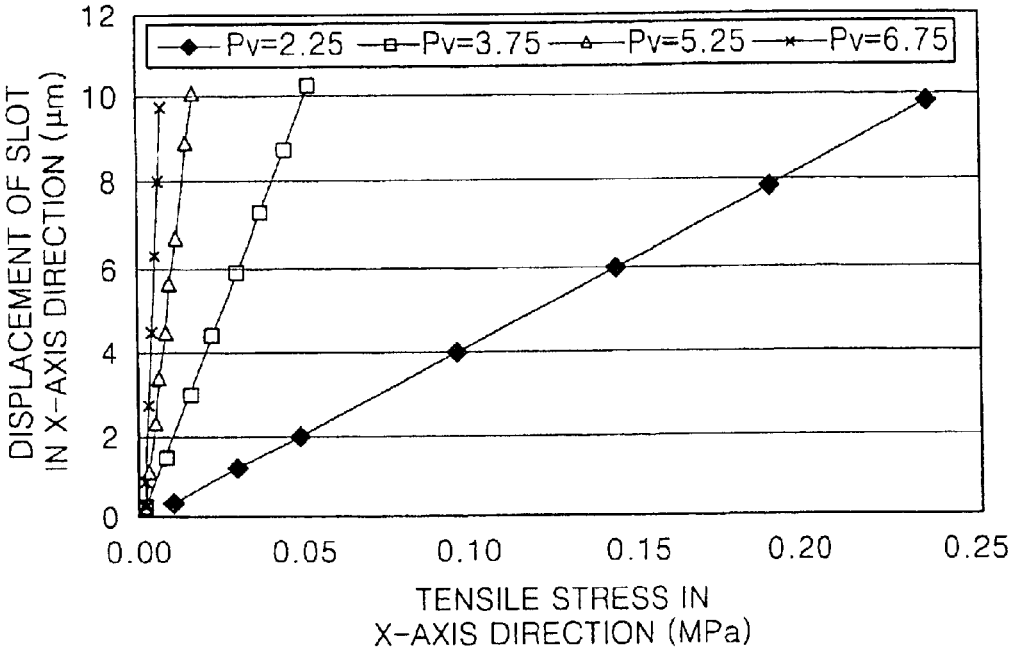
FIGS. 11 and 12 are graphs of the displacement of slots in an X-axis direction versus tensile stress applied to a mask in X-axis and Y-axis directions, respectively.
Figure 12:
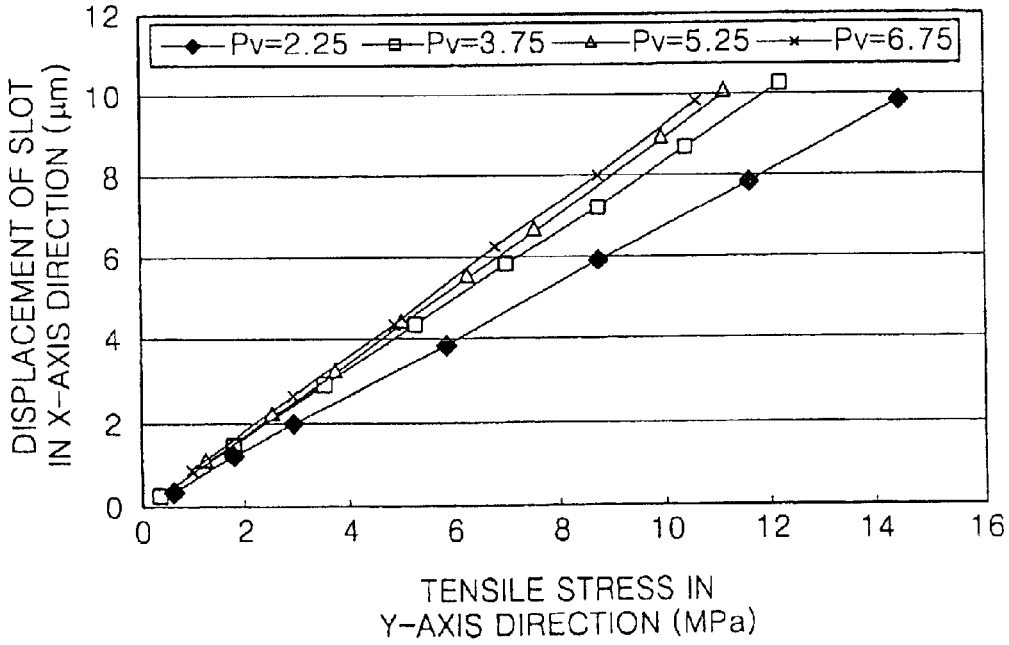

Under the same conditions of Experiment 1, the quantities of displacement of slots in the Y-axis direction were divided by the length L of each slot, and the quantities of displacement of the slots in the X-axis direction were measured, so a graph shown in FIG. 10 was obtained. In addition, tensile stresses applied to a tension mask in Y- and X-axis directions were measured with respect to the quantities of displacement of the slots in the X-axis direction, so graphs shown in FIGS. 11 and 12 were obtained.

It can be seen from the graphs that the quantities of displacement of slots formed in a tension mask in the X-axis direction do not influence a tensile stress applied to the tension mask in the Y-axis direction and the pitch of the slots very much.

Experiment 3

Variations in the widths of the middle portion and the upper or lower portion of a slot were measured when tension was applied to a tension mask having a slot pitch of 9.75 mm and a tension mask having a slot pitch of 6.75 mm in Experiment 3. The results of Experiment 3 are shown in Tables 1 and 2. Here, 34-inch tension masks (diagonally measured) were used, and the measurement was performed on a slot at the center of each of the tension masks.

TABLE 1

| | Slot pitch: 9.75 mm | | | |
|---|---|---|---|---|
| | Minimum | Width after application of tension | Variation | Deformation rate |
| Width SW3 of middle portion of slot | 155 μm (microns) | 192 μm | 37 μm | 23.87% |
| Width SW4 of upper or lower portion of slot | 195 μm | 191 μm | −4 μm | −2.05% |

TABLE 1-continued

| | Slot pitch: 9.75 mm | | | |
|---|---|---|---|---|
| | Minimum | Width after application of tension | Variation | Deformation rate |
| SW4/SW3 | | 1.258065 | | |

TABLE 2

| | Slot pitch: 6.75 mm | | | |
|---|---|---|---|---|
| | Minimum | Width after application of tension | Variation | Deformation rate |
| Width SW3 of middle portion of slot | 190 μm | 194 μm | 4 μm | 2.11% |
| Width SW4 of upper or lower portion of slot | 195 μm | 193 μm | −2 μm | −1.03% |
| SW4/SW3 | | 1.026316 | | |

It can be inferred from Tables 1 and 2 that in the case where the width SW3 of the middle portion of a slot was narrow such that a difference between the width SW3 of the middle portion of a slot and the width SW4 of the upper or lower portion of the slot (SW4-SW3) was 40 μm in a mask having a slot pitch of 9.75 mm and a difference, SW4-SW3, was 5 μm in a mask having a slot pitch of 6.75 mm in a state where tension is not applied to the tension masks, when tension was applied to each of the tension masks in a lengthwise direction of strips, the strips corresponding to the middle portion of the slot were stretched resulting in a 1 μm difference between the widths SW3 and SW4, so the slots became substantially rectangular.

Particularly, ratios of the widths SW4 of the upper or lower portions of the slots to the widths SW3 of the middle portions of the slots, SW4/SW3, were 1.0 and 1.2.

COMPARISON EXAMPLE 1

Under the same conditions of Experiment 3, variations in the width SW3 of the middle portion of a slot and in the width SW4 of the upper or lower portion of the slot were measured when tension was applied to a tension mask having a slot pitch of 11.25 mm. The results of measurement are shown in Table 3. Here, 34-inch tension masks were used, and the measurement was performed on a slot at the center of the tension mask.

TABLE 3

| | Slot pitch: 11.25 mm | | | |
|---|---|---|---|---|
| | Minimum | Width after application of tension | Variation | Deformation rate |
| Width SW3 of middle portion of slot | 145 μm | 180 μm | 35 μm | 24.14% |
| Width SW4 of upper or lower portion of slot | 195 μm | 190 μm | −5 μm | −2.56% |
| SW4/SW3 | | 1.344828 | | |

It can be inferred from Table 3 that in the case where the width SW3 of the middle portion of a slot was relatively narrower than in Experiment 3 such that a difference between the width SW3 of the middle portion of the slot and the width SW4 of the upper or lower portion of the slot (SW4-SW3) was 45 μm in the mask having the slot pitch of 11.25 mm, when tension was applied to the tension mask in a lengthwise direction of strips, the strips corresponding to the middle portion of the slot were pulled resulting in a 10 μm difference between the widths SW3 and SW4, so the slot is distorted.

Particularly, a ratio of the width SW4 of the upper or lower portion of the slot to the width SW3 of the middle portion of the slot, SW4/SW3, was 1.344.

COMPARISON EXAMPLE 2

Under the same conditions of Experiment 3, variations in the width SW3 of the middle portion of a slot and in the width SW4 of the upper or lower portion of the slot were measured when tension was applied to a tension mask having a slot pitch of 5.25 mm, a tension mask having a slot pitch of 9.75 mm, a tension mask having a slot pitch of 6.75 mm, and a tension mask having a slot pitch of 11.25 mm. The results of the measurements are shown in Tables 4 through 7. Here, 34-inch tension masks were used, and the measurement was performed on a slot at the center of each of the tension masks.

TABLE 4

| | Slot pitch = 5.25 mm | | | |
|---|---|---|---|---|
| Position | Minimum | Width after application of tension | Variation | Deformation rate |
| Width SW3 of middle portion of slot | 195 μm | 197.1 μm | 2.1 | +1.1% |
| Width SW4 of upper or lower portion of slot | 195 μm | 192.55 μm | 2.45 | 1.3% |
| Displacement of upper or lower portion with respect to middle portion | | | | 2.40% |

Tension to strip: 397 kgf (kilogram-force) at middle portion of slot, 88 kgf at upper or lower portion of slot

TABLE 5

| | Slot pitch = 6.75 mm | | | |
|---|---|---|---|---|
| Position | Minimum | Width after application of tension | Variation | Deformation rate |
| Width SW3 of middle portion of slot | 195 μm | 199.7 μm | 4.7 | 2.14% |
| Width SW4 of upper or lower portion of slot | 195 μm | 193.8 μm | 1.2 | 0.62% |
| Displacement of upper or lower portion with respect to middle portion | | | | 3.00% |

Tension to strip: 397 kgf at middle portion of slot, 88 kgf at upper or lower portion of slot

TABLE 6

| Position | Slot pitch = 9.75 mm | | | |
|---|---|---|---|---|
| | Minimum | Width after application of tension | Variation | Deformation rate |
| Width SW3 of middle portion of slot | 195 μm | 205 μm | 10 | +4.88% |
| Width SW4 of upper or lower portion of slot | 195 μm | 192 μm | −3 | −1.56% |
| Displacement of upper or lower portion with respect to middle portion | | | | 6.44% |

TABLE 7

| Position | Slot pitch = 1.25 mm | | | |
|---|---|---|---|---|
| | Minimum | Width after application of tension | Variation | Deformation rate |
| Width SW3 of middle portion of slot | 195 μm | 220 μm | 25 | 12.82% |
| Width SW4 of upper or lower portion of slot | 195 μm | 188 μm | −7 | −3.59% |
| Displacement of upper or lower portion with respect to middle portion | | | | 16.41% |

As shown in Tables 4 through 7, in the case where the widths of the middle portions and the upper or lower portions of slots were uniform, the slots were distorted very much in response to application of tension such that a difference between the width of the middle portion of a slot and the width of the upper and lower portions of the slot was in the range of 5–42 μm (microns).

It can be concluded based on the above experiments and comparison examples that the distortion of a slot occurring when tension is applied can be minimized by forming a slot such that a value obtained by dividing the width SW4 of an upper or lower portion of the slot by the width SW3 of a middle portion of the slot is greater than 1.0 and less than 1.3 (1.0<SW4/SW3<1.3).

In a tension mask for a color CRT and a tension mask frame assembly according to the present invention, slots are formed such that the width of a middle portion of each slot is narrower than the width of upper and lower portions of the corresponding slot, thereby preventing the slots from being distorted due to tension applied to strips. By preventing the distortion of the slots, the collimation of an exposure pattern for forming a phosphor layer can be improved.

While this invention has been particularly shown and described with reference to preferred embodiments thereof, the preferred embodiments are used in descriptive sense only. It will be understood by those skilled in the art that various changes in forms and details maybe made therein. Therefore, the scope of the invention will be defined by the appended claims.

What is claimed is:

1. A tension mask for a color cathode-ray tube, comprising a plurality of strips separated by a predetermined distance and connected by real bridges, said strips together with said real bridges defining a plurality of slots, an electron beam passing through the slots, the width of middle portions of the slots being narrower than the width of upper and lower portions of the slots according to tension applied to said strips.

2. The tension mask of claim 1, further comprising dummy bridges extending from at least one side of each of said strips defining the slots.

3. The tension mask of claim 2, said dummy bridges extending from facing sides of adjacent strips toward the center of slots defined by the adjacent strips such that the ends of said dummy bridges do not physically contact.

4. The tension mask of claim 3, further comprised of tension being applied to said strips in a lengthwise direction.

5. The tension mask of claim 1, further comprising dummy bridges extending from one side of each of said strips toward the other side, said strips defining the slots.

6. The tension mask of claim 1, further comprised of tension being applied to said strips in a lengthwise direction.

7. The tension mask of claim 1, further comprised of the values of SW4/SW3 in a central portion of said tension mask being different from the values of SW4/SW3 in an outer portion of said tension mask, where the width of middle portions of the slots is SW3 and the width of upper and lower portions of the slots is SW4.

8. The tension mask of claim 1, with the slots gradually decreasing width from opposing end portions to the middle portion of the slots.

9. The tension mask of claim 1, further comprising values of SW4/SW3 being adjusted according to a portion of the tension mask taking into account Poisson contraction based on tension applied to the strips, where the width of middle portions of the slots is SW3 and the width of upper and lower portions of the slots is SW4.

10. The tension mask of claim 1, comprising:

a plurality of strips separated by a predetermined distance and connected by real bridges, said strips together with said real bridges defining a plurality of slots, an electron beam passing through the slots; and a part on each slot compensating contraction according to application of a certain tension applied to said strips of each slot.

11. A tension mask for a color cathode-ray tube, comprising a plurality of strips separated by a predetermined distance and connected by real bridges, said strips together with said real bridges defining a plurality of slots, an electron beam passing through the slots, the width of middle portions of the slots being narrower than the width of upper and lower portions of the slots, further comprised of both longer sides of each of the slots being defined by said strips and said real bridges including convex curves.

12. A tension mask for a color cathode-ray tube, comprising a plurality of strips separated by a predetermined distance and connected by real bridges, said strips together with said real bridges defining a plurality of slots, an electron beam passing through the slots, the width of middle portions of the slots being narrower than the width of upper and lower portions of the slots, further comprised of the slots satisfying the following relationship:

$$1.0 < SW4/SW3 < 1.3$$

where the width of middle portions of the slots is SW3 and the width of upper and lower portions of the slots is SW4.

13. The tension mask of claim 12, further comprised of the values of SW4/SW3 in a central portion of said tension mask being different from the values of SW4/SW3 in an outer portion of said tension mask.

14. A tension mask for a color cathode-ray tube, comprising a plurality of strips separated by a predetermined distance and connected by real bridges, said strips together with said real bridges defining a plurality of slots, an electron beam passing through the slots, the width of middle portions of the slots being narrower than the width of upper and lower portions of the slots, with the slots continuously decreasing width from opposing end portions to the middle portion of the slots.

15. A tension mask for a color cathode-ray tube, comprising a surface including a plurality of slots accommodating the passing of an electron beam, the width of middle portions of the slots being narrower than the width of upper and lower portions of the slots when no tension is applied to said tension mask and the width of middle portions of the slots being approximately the same as the width of upper and lower portions of the slots when tension is applied to said tension mask, the upper portion of the slots being an area above the middle portion and up to and including an upper end portion of the slots, the lower portion of the slots being an area below the middle portion and up to and including the lower end portion of the slots.

16. The tension mask of claim 15, said surface further comprising a plurality of strips separated by a predetermined distance and connected by real bridges, said strips together with said real bridges defining the slots, the ratios of the width of middle portions of the slots and the width of upper and lower portions of the slots being varied according to a portion of said tension mask taking into account Poisson contraction based on tension applied to said strips.

17. The tension mask of claim 15, further comprised of the values of SW4/SW3 in a central portion of said tension mask being different from the values of SW4/SW3 in an outer portion of said tension mask, where the width of middle portions of the slots is SW3 and the width of upper and lower portions of the slots is SW4.

18. The tension mask of claim 15, further comprised of one of the longer sides of the slots including a continuous convex curve from the upper portion to the lower portion of the slots.

19. A tension mask for a color cathode-ray tube, comprising a surface including a plurality of slots accommodating the passing of an electron beam, the width of middle portions of the slots being narrower than the width of upper and lower portions of the slots when no tension is applied to said tension mask, the upper portion of the slots being an area above the middle portion and up to and including an upper end portion of the slots, the lower portion of the slots being an area below the middle portion and up to and including the lower end portion of the slots, further comprised of each one of the plurality of slots satisfying the following relationship:

$$1.0<SW4/SW3<1.3$$

where the width of middle portions of the slots is SW3 and the width of upper and lower portions of the slots is SW4.

20. The tension mask of claim 19, further comprised of the values of SW4/SW3 in a central portion of said tension mask being different from the values of SW4/SW3 in an outer portion of said tension mask.

21. The tension mask of claim 20, further comprised of one of the longer sides of the slots including a continuous convex curve from the upper portion to the lower portion of the slots.

22. A tension mask for a color cathode-ray tube, comprising a surface including a plurality of slots accommodating the passing of an electron beam, the width of middle portions of the slots being narrower than the width of upper and lower portions of the slots when no tension is applied to said tension mask, the upper portion of the slots being an area above the middle portion and up to and including an upper end portion of the slots, the lower portion of the slots being an area below the middle portion and up to and including the lower end portion of the slots, said surface further comprising a plurality of strips separated by a predetermined distance and connected by real bridges, said strips together with said real bridges defining the slots, the value of SW4/SW3 of each one of the plurality of slots being varied within the range of 1.0<SW4/SW3<1.3 according to a distribution of tension applied to said strips and a vertical pitch of the slots.

23. A tension mask for a color cathode-ray tube, comprising:

a plurality of strips separated by a predetermined distance;

a plurality of real bridges connecting said plurality of strips, said strips together with said real bridges defining slots, an electron beam passing through the slots, the width of middle portions of the slots being narrower than the width of upper and lower portions of the slots when no tension is applied to said strips, the upper portion of the slots being an area above the middle portion and up to and including an upper end portion of the slots, the lower portion of the slots being an area below the middle portion and up to and including the lower end portion, both longer sides of each of the slots being defined by said strips and said real bridges including convex curves, the slots satisfying the following relationship:

$$1.0<SW4/SW3<1.3$$

where the width of middle portions of the slots is SW3 and the width of upper and lower portions of the slots is SW4, the values of SW4/SW3 in a central portion of said tension mask being different from the values of SW4/SW3 in an outer portion of said tension mask, tension being applied to said strips in a lengthwise direction.

24. The tension mask of claim 23, further comprising dummy bridges extending from at least one side of each of said strips defining the slots.

25. The tension mask of claim 24, said dummy bridges extending from facing sides of adjacent strips toward the center of slots defined by the adjacent strips such that the ends of said dummy bridges do not physically contact.

26. The tension mask of claim 23, further comprising dummy bridges extending from one side of each of said strips toward the other side, said strips defining the slots.

* * * * *